United States Patent [19]

Ikimi et al.

[11] Patent Number: 4,706,781

[45] Date of Patent: Nov. 17, 1987

[54] FLUID-OPERATED CYLINDER WITH CUSHIONING FLOW RATE CONTROL VALVE MEANS

[75] Inventors: Yoshihiro Ikimi; Osamu Tsukada, both of Kariya, Japan

[73] Assignee: Kabushiki Kaisha Toyoda Jidoshokki Seisakusho, Aichi, Japan

[21] Appl. No.: 833,952

[22] Filed: Feb. 27, 1986

[30] Foreign Application Priority Data

Feb. 28, 1985 [JP] Japan ..... 60-28790[U]
Feb. 28, 1985 [JP] Japan ..... 60-28791[U]

[51] Int. Cl.[4] ..... B66F 9/22; F15B 15/22

[52] U.S. Cl. ..... 187/9 E; 187/9 R; 91/399; 91/405

[58] Field of Search ..... 91/396, 395, 394, 399, 91/405–407, 416; 187/9 R, 9 B

[56] References Cited

U.S. PATENT DOCUMENTS

| | | | |
|---|---|---|---|
| 1,141,447 | 6/1915 | Dellwitz | 91/416 X |
| 2,078,780 | 4/1937 | Slater | 91/416 X |
| 2,951,558 | 9/1960 | Schuster | 187/9 E |
| 3,023,739 | 3/1962 | Dickinson, Jr. et al. | 91/405 X |
| 3,232,180 | 2/1966 | Deschenes | 91/416 X |
| 3,974,910 | 8/1976 | Papai | 91/394 X |
| 3,998,132 | 12/1976 | Rasigade | 91/395 |
| 4,207,802 | 6/1980 | Homuth | 91/405 |
| 4,250,793 | 2/1981 | Berg | 91/407 |

FOREIGN PATENT DOCUMENTS

| | | | |
|---|---|---|---|
| 451779 | 10/1948 | Canada | 91/395 |

*Primary Examiner*—Joseph J. Rolla
*Assistant Examiner*—Nils Pedersen
*Attorney, Agent, or Firm*—Burgess, Ryan & Wayne

[57] ABSTRACT

A fluid-operated cylinder to be used as a load lifting cylinder includes a cylinder casing defining a cylinder bore between two opposed ends, one of which ends is provided with a fluid supply/discharge port, a piston unit having a piston element and a piston rod, the piston unit being axially movably arranged in the cylinder bore of the cylinder casing, and a flow rate control valve unit axially movably mounted in the piston element so as to cause a gradual change in a flow rate of working fluid throughout a predetermined amount of piston stroke when the piston unit starts to move out of the cylinder casing and comes to a stop at a bottom position in the cylinder casing, thereby cushioning shock occurring in the fluid-operated cylinder.

9 Claims, 7 Drawing Figures

FLUID-OPERATED CYLINDER WITH CUSHIONING FLOW RATE CONTROL VALVE MEANS

BACKGROUND OF THE INVENTION

1. Field of the Invention

The present invention relates to a fluid-operated cylinder adapted for use as a load lifting cylinder for industrial load handling machines, such as a lift truck and an automated guided vehicle. More particularly, the present invention relates to a fluid-operated cylinder provided with a flow rate control valve operable to cushion a shock occurring when the piston of the fluid-operated cylinder starts from and stops at the ends of a piston stroke.

2. Description of the Related Art

It is well known that in the conventional fluid-operated lift cylinder used, for example, for industrial lift trucks, a shock occurs when the piston begins to move from and stops at the ends of the piston stroke. To eliminate this defect, there has already been proposed a shock cushioning mechanism incorporated in the lift cylinder. However, when the operation of this conventional shock cushioning mechanism (explained later in detail with reference to the drawings) is considered, it is obvious that the mechanism cannot decelerate the movement of the piston through the final stage of the downward piston stroke. That is, the piston has a constant speed even when it comes to the downward end of piston stroke. Therefore, the shock cushioning mechanism cannot completely cushion a shock which occurs when the piston reaches the bottom of the cylinder casing 20. Further, this conventional shock cushioning mechanism cannot absorb a shock which occurs when the piston is moved upward from the bottom of the cylinder casing. This is because the fixed and movable throttle valves of this prior art mechanism cannot control the speed of the upward movement of the piston and piston rod. Also, the conventional fluid-operated cylinder is not provided with a means for cushioning a shock occurring when the piston reaches the upper end of the piston stroke and starts to move down to begin the downward piston stroke.

SUMMARY OF THE INVENTION

An object of the present invention is to provide a fluid-operated cylinder capable of eliminating the above-mentioned defects encountered by the conventional shock cushioning mechanism of a fluid-operated lift cylinder.

Another object of the present invention is to provide a fluid-operated cylinder adapted for use as a load lifting cylinder with a flow rate control valve means which can effectively cushion a shock occurring when the axial piston motion starts and stops at both the top and bottom ends of the piston stroke.

A further object of the present invention is to provide a load lifting cylinder provided with a novel shock cushioning means and adapted for accommodation in industrial load-handling wheeled machines, such as an industrial lift truck.

In accordance with the present invention, there is provided a fluid-operated cylinder adapted for use as a load lifting cylinder, which comprises:

a cylinder casing having a cylindrical bore axially extended between first and second ends thereof, the first end of the casing having a fluid supply/discharge port formed at an inner portion thereof, the port having a valve seat, and the second end of the casing having an open end through which a piston rod is axially movably received in the cylinder bore;

a piston element arranged at an inner end of the piston rod so as to be movable together with the piston rod and having first and second pressure-receipt faces, the first pressure-receipt face defining, in the cylindrical bore of the cylinder casing, a first cylinder chamber adjacent to the fluid/supply discharge port, and the second pressure-receipt face defining, in the cylindrical bore of the cylinder casing, a second cylinder chamber extending around the piston rod, and;

a flow rate control valve unit axially movably arranged in the piston element and cooperating with the valve seat so as to cause a gradual change in a flow rate of working fluid flowing from the fluid supply/discharge port to the first cylinder chamber and vice versa, through a predetermined amount of piston stroke when the piston element and the piston rod move away from and toward a bottom position adjacent to the fluid supply/discharge port, thereby cushioning a shock generated in the fluid-operated cylinder at a time of a start or a stop of movement of the piston element.

Other objects, features, and advantages of the present invention will be made more apparent from the ensuing description taken in conjunction with the attached drawings.

DESCRIPTION OF THE PREFERRED EMBODIMENTS

Figure 1:
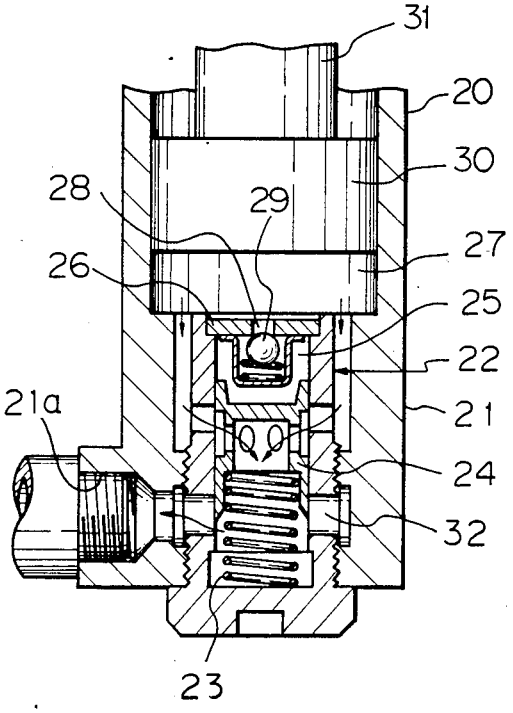
Fig. 1 PRIOR ART
FIG. 1 is a vertical cross sectional view of a shock cushioning mechanism of a load lifting cylinder according to the prior art.

FIG. 1 illustrates a typical shock cushioning mechanism provided in a conventional fluid-operated lift cylinder. In FIG. 1, the conventional fluid-operated lift cylinder includes a cylinder casing 20 having a bottom portion 21 formed with a fluid supply/discharge port 21*a* through which a working fluid, such as pressurized oil, is supplied to or discharged from the cylinder casing 20. A shock cushioning mechanism comprises a fixed throttle valve 22 in the shape of a capped cylinder fixed to the lower end of the bottom portion 21, a movable throttle valve 24 vertically movably mounted in the fixed throttle valve 22 and urged upward by a spring 23, a cap plate 26 attached to the top of the fixed throttle valve 22 and defining, with the fixed throttle valve 22 and the movable throttle valve 24, a pressure chamber 25, and a check valve 29 provided so as to cooperate with a through-hole 28 formed in the cap plate 26, to allow communication between the pressure chamber 25 and a bottom cylinder chamber 27 of the cylinder casing 20. The operation of this conventional shock cushioning mechanism is as follows. That is, when a piston 30 and a piston rod 31 approach the bottom portion 21, fluid pressure in the bottom cylinder chamber 27 increases and urges the check valve 29 to open the through-hole 28 of the cap plate 26. As a result, the working fluid in the bottom cylinder chamber 27 flows into the pressure chamber 25 while pressing down the movable throttle valve 24 against the spiral spring 23. Consequently, the movable throttle valve 24 closes a part of a fluid passageway 32 formed in the cylinder casing 20 and the fixed throttle valve 22. That is, the cross-sectional area of the fluid passageway 32 is reduced. Accordingly, the amount of working fluid discharged from the bottom cylinder chamber 27 is decreased so that the speed of downward movement of the piston is not increased. However, when the operation of the above-mentioned shock cushioning mechanism is considered in detail, it is obvious that the mechanism is unable to decelerate the movement of the piston through the final stage of the downward piston stroke. That is, the piston has a constant speed even when reaching the downward end of the piston stroke. Therefore, the shock cushioning mechanism cannot completely cushion a shock occurring when the piston reaches the bottom face of the bottom portion 21 of the cylinder casing 20. Further, the conventional shock cushioning mechanism does not effectively absorb a shock occurring when the piston is moved upward from the bottom of the cylinder casing 20 by the supply of the working fluid from the fluid/supply discharge port 21*a*. This is because the fixed and movable throttle valves 22 and 24 do not function to control the speed of the upward movement of the piston 30 and piston rod 31. Also, the conventional fluid-operated cylinder is not provided with a means for cushioning a shock occurring when the piston 30 reaches the upper end of the piston stroke and when the piston 30 starts to move down to carry out the downward piston stroke.

Figure 2:
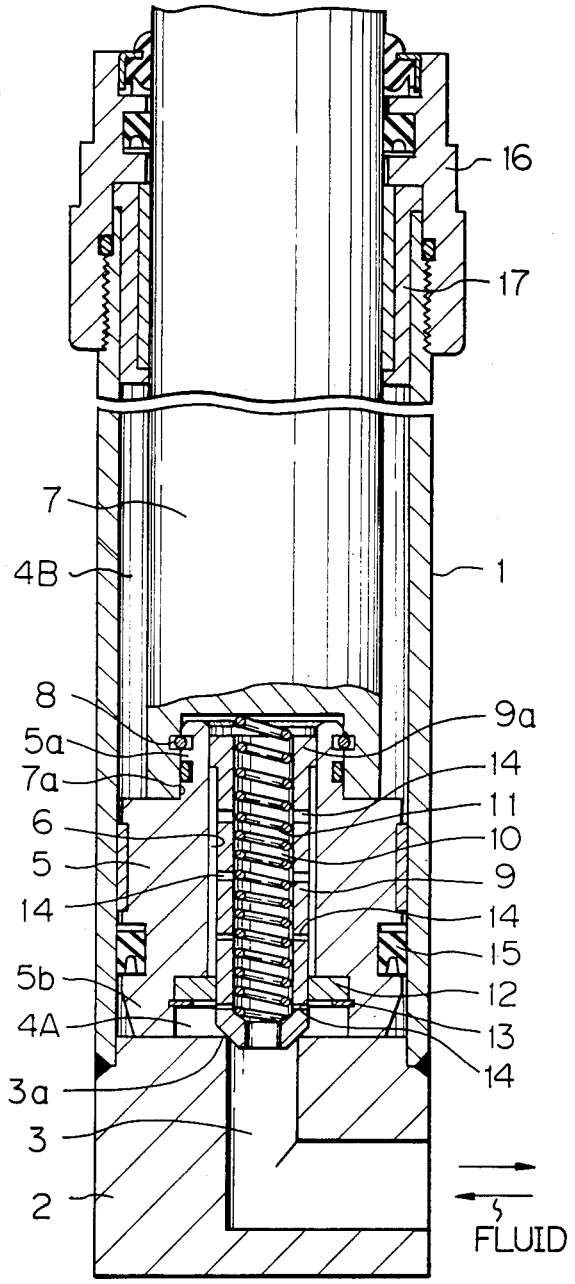
FIG. 2 is a vertical cross sectional view of a featured portion of a fluid-operated cylinder, according to a first embodiment of the present invention, illustrating a state wherein a piston is moved down to the lowermost position thereof in a cylinder casing.
Figure 3:
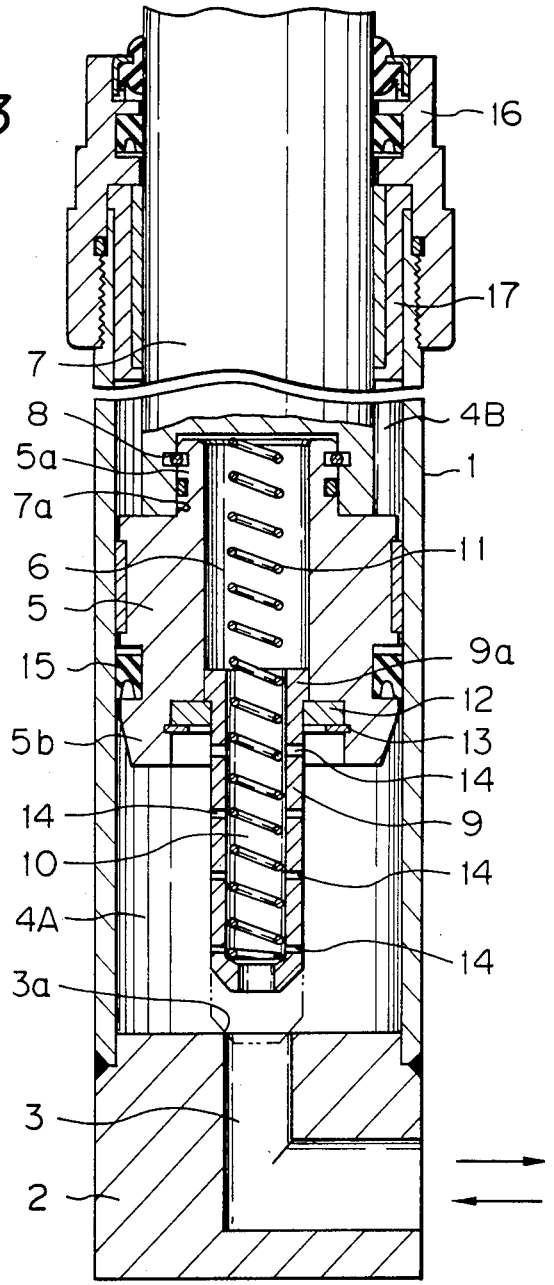
FIG. 3 is a similar vertical cross sectional view of the same cylinder as shown in FIG. 2, illustrating another state wherein the piston is at a position adjacent to and above the lowermost position thereof in the cylinder casing.

Referring to FIGS. 2 and 3, according to a first embodiment of the present invention, a fluid-operated cylinder includes a cylinder casing 1 having a cylinder bottom 2 attached to the lowermost end of the cylinder casing by, for example, welding. The cylinder bottom 2 is formed with a fluid supply/discharge port 3 connected to a fluid supply/discharge circuit (not illustrated in FIGS. 2 and 3). The fluid supply and discharge port 3 has a central bore portion coaxial with a cylindrical bore of the cylinder casing 1. Thus, the fluid supply/discharge port 3 is in fluid communication with a bottom cylinder chamber 4A defined in the cylindrical bore of the cylinder casing 1. Also defined in the cylindrical bore of the cylinder casing 1 is an upper cylinder chamber 4B separated by a piston element 5 and extending around a piston rod 7. The piston element 5 is slidably and snugly fitted in the cylindrical bore of the cylinder casing 1 and is able to move axially in the cylinder casing 1. The piston element 5 is centrally formed with an axially extending cylindrical bore 6, and at the top thereof, is also formed with an axial extension 5*a* having a reduced diameter, which extension 5*a* is fitted in a cylindrical counter bore 7*a* formed in the lowermost end of the piston rod 7. A snap ring 8 is provided for fixing the axial extension 5*a* to the piston rod 7. The piston element 5 has at the lowermost end thereof, an annular seating portion 5*b* projecting toward the cylinder bottom 2. The piston rod 7 is axially and upwardly extended through an upper open end of the cylinder casing 1, to operate as a plunger means. The upper open end of the cylinder casing 1 is fluid-tightly covered by a rod covering 16 and is provided with a fixed annular member 17 that limits the upward movement of the piston element 5 in the cylinder casing 1.

A flow rate control valve 9 in the form of a cylindrical hollow member is mounted in the cylindrical bore 6 of the piston element 5, and is able to slide in the axial direction of the cylindrical bore 6. The flow rate control valve 9 is arranged coaxially with the central bore portion of the fluid supply/discharge port 3 and cooperates with a valve seat 3*a*, formed at the innermost end of the central bore portion of the fluid supply/discharge port 3, to control the flow rate of a working fluid supplied to and discharged from the cylinder bottom chamber 4A, as described later. The flow rate control valve 9 has an axially extending cylindrical bore 10 in which a spiral spring member 11 is accommodated. The spring member 11 has one end abutting against the bottom of the cylindrical counter bore 7*a* of the piston rod 7 and the other end seated against the bottom of the cylindrical bore 10 of the flow rate control valve 9. Thus, the spring member 11 constantly urges the valve 9 toward a position extending outward from the lowermost face of the piston element 5. In FIG. 2, the piston element 5 is shown at the lowermost position thereof within the cylinder casing 1, and the flow rate control valve 9 urged by the spring member 11 is in contact with the valve seat 3*a* of the fluid supply/discharge port 3 at a chamfered end of the valve 9. However, the flow rate control valve 9, per se, is moved to a position at which it is most retracted in the cylindrical bore 6 of the piston element 5. A stop 12 in the form of annular ring member is mounted inside the annular seating portion 5*b* of the piston element 5 and fixed to the portion 5*b* by a conventional snap ring 13. The stop 12 is formed so that an inner diameter of the bore thereof is smaller than the inner diameter of the cylindrical bore 6 of the piston element 5 and permits the flow rate control valve 9 to be slidably and snugly fitted in the bore. As best illustrated in FIG. 3, the stop 12 is provided so as to cooperate with a flange portion 9*a* of the valve 9, to stop the outward movement of the valve at a predetermined position, i.e., the afore-mentioned position most axially extended from the lowermost face of the piston element 5. Further, the flow rate control valve 9 is provided, in the cylindrical wall portion thereof, with a plurality of orifices 14 arranged so as to be axially spaced from one another. The orifices 14 of the flow rate control valve 9 are very effective for carrying out the shock cushioning operation described later for the case wherein piston 5 starts to move from the lowermost position within the cylinder casing 1, and the case wherein the movement thereof stops at the lowermost position. That is, when the flow rate control valve 9 is in contact with the valve seat 3*a* of the fluid supply discharge port 3, so that direct communication between the port 3 and the bottom cylinder chamber 4A is interrupted, the orifices 14 operate to control the flow rate of the working fluid flowing from the fluid supply/discharge port 3 toward the bottom cylinder chamber 4A, and vice versa, in compliance with a change in position of the piston element 5 with regard to the lowermost position thereof. In the embodiment of FIGS. 2 and 3, the orifices 14 are arranged in four positions axially spaced in a longitudinal direction of the flow rate control valve 9, and the lowermost orifices 14 are located so that when the piston element 5 is at its lowermost position and when the flow rate control valve is at the most retracted position, the fluid supply/discharge port 3 is communicated with the bottom cylinder chamber 4A by way of only the lowest orifices 14. Moreover, the orifices 14 are formed in such a manner that the diameters of the orifices 14 are made gradually larger from the lowermost orifices to the uppermost orifices. A packing 15 is attached to an outer circumference of the piston element 5 in the known manner.

The operation of the shock cushioning operation of the flow rate control valve 9 will be described hereinbelow in connection with the downward and upward movements of the piston within the cylinder casing 1.

In FIG. 2 illustrating a state wherein the piston element 5 is at the lowermost position thereof in the cylinder casing 1, the bottom cylinder chamber 4A is in fluid communication with the fluid supply/discharge port 3 via the lowest orifices 14. At this stage, when the working fluid, i.e., a pressurized fluid, is supplied from the outer fluid circuits into the supply/discharge port 3 so as to move the piston element 5 in the upward direction, the working fluid is permitted to flow through the axially extending cylindrical bore 10 of the flow rate control valve 9 and the lowermost orifices 14 into the bottom cylinder chamber 4A. As a result, the piston element 5 starts to move upward under the pressure of the working fluid within the chamber 4A. However, the control valve 9 urged downward by the spiral spring 11 is held at the position where the valve 9 is in contact with the valve seat 3*a*. Therefore, in compliance with the upward movement of the piston element 5, the control valve 9 extends outside of the cylindrical bore 6 of the piston element 5, and the orifices 14 arranged in the uppermost positions are successively exposed to the bottom cylinder chamber 4A. Thus, fluid communication between the bottom cylinder chamber 4A and the port 3 is gradually increased. That is, the flow of the working fluid flowing into the bottom cylinder chamber 4A is gradually increased at a rate regulated by the exposed orifices 14 in accordance with the upward movement of the piston element 5. Accordingly, the movement of the piston element 5 is at first slow, and is gradually accelerated to a higher speed through the upward stroke thereof. When the stop 12 abuts against the flange portion 9*a* of the control valve 9, the control valve 9 is pulled upward by the piston element 5 and moved with the piston element 5. As a result, as shown in FIG. 3 by a solid line, the control valve 9 is separated from the valve seat 3*a*. Thus, the fluid supply/discharge port 3 is directly communicated with the bottom cylinder chamber 4A so that a sufficient amount of the working fluid flows into the chamber 4A. Then, the piston element 5 together with the piston rod 7 move up at an appropriate high speed while carrying out a load lifting operation. Accordingly, it will be understood that, at the start of the upward movement of the piston, a sudden acceleration of the piston element 5 does not occur, and that no appreciable shock is felt in the fluid-operated cylinder.

On the other hand, when the piston element 5 is lowered and approaches the lowermost position thereof, at this time the flow rate control valve 9 operates so as to gradually lower or decelerate the speed of the piston element 5. That is, before the control valve 9 moving downward with the piston element 5 comes into contact with the valve seat 3*a*, the working fluid in the bottom cylinder chamber 4A is directly discharged therefrom into the fluid supply/discharge port 3, so that the piston element 5 moves downward at a relatively high speed. However, after the control valve 9 comes into contact with the valve seat 3*a*, as illustrated in FIG. 3 by a phantom line, the working fluid within the bottom cylinder chamber 4A is discharged into the port 3 only through the orifices 14 and the cylindrical bore 10 of the control valve 9. Therefore, the flow rate of the working fluid is restricted. In addition, in compliance with the downward movement of the piston element 5 toward the lowermost position thereof, the control valve 9 is relatively retracted into the cylindrical bore 6 of the piston element 5, so that the orifices 14 arranged on the upper side of the control valve 9 are gradually concealed in the cylindrical bore 6. Thus, the flow rate of the working fluid is further restricted, i.e., subjected to a throttling effect, by the control valve 9. As a result the speed of the downward movement of the piston element 5 is gradually decreased. The slowing down of the piston element 5 ensures that the seating portion 5*b* of the piston element 5 is stopped on the bottom face of the cylinder bottom 2 without causing an appreciable shock. That is, the fluid rate control valve 9 operates so as to cushion the piston element 5.

From the foregoing description of the embodiment of the present invention, it will be fully understood that, in the fluid-operated cylinder of the present invention, effective shock cushioning or shock absorbing is carried out. Therefore, when such a fluid-operated cylinder is used as a load lifting cylinder in an industrial load handling wheeled machine, such as an industrial lift truck, accidents such as a loosening of a load on the truck or a falling of a load from the truck onto a floor surface, can be prevented. Consequently, the safety of the load handling operation by the operator of the industrial load handling machine can be guaranteed. Further, since the shock cushioning flow rate control valve of the present invention is accommodated in the piston (the piston element or piston rod), it is not necessary to increase the length of the fluid-operated cylinder for obtaining a desired length of the piston stroke in the cylinder casing. At this stage, it should be noted that the number of orifices arranged in a plurality of positions along the length of the flow rate control valve is not limited to the four illustrated in the embodiment of FIGS. 2 and 3. It should be further noted that the diameters of all orifices may be equal, as required.

Figure 4:
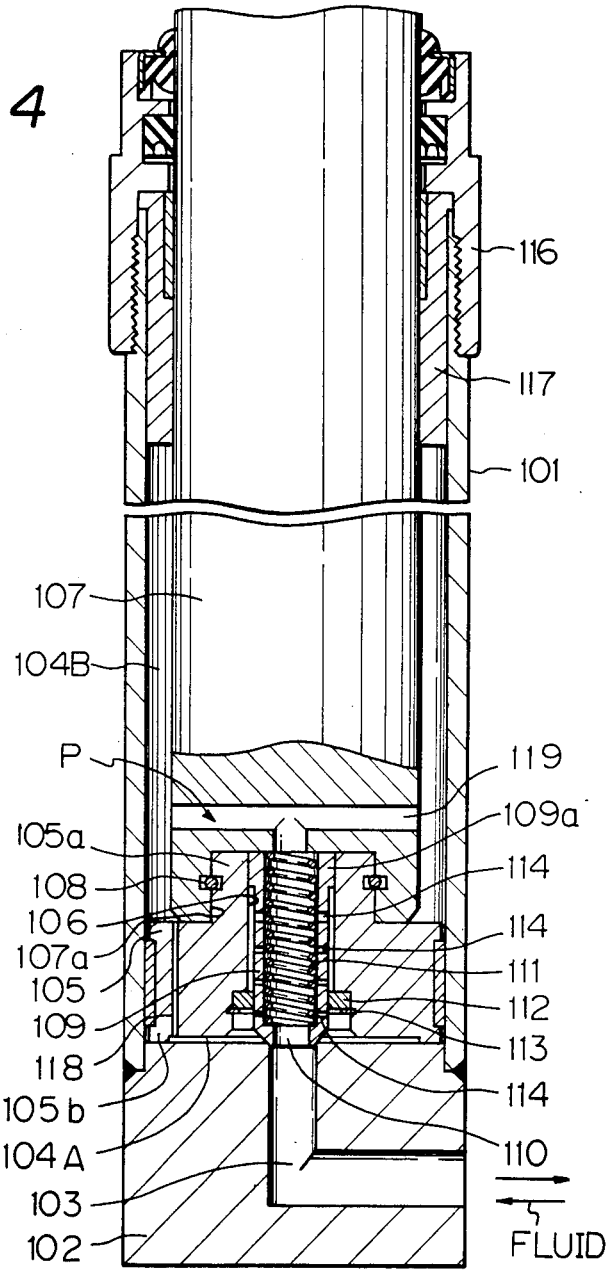
FIG. 4 is a cross sectional view of a fluid-operated cylinder, according to a second embodiment of the present invention, illustrating the same state as shown in FIG. 2.
Figure 5:
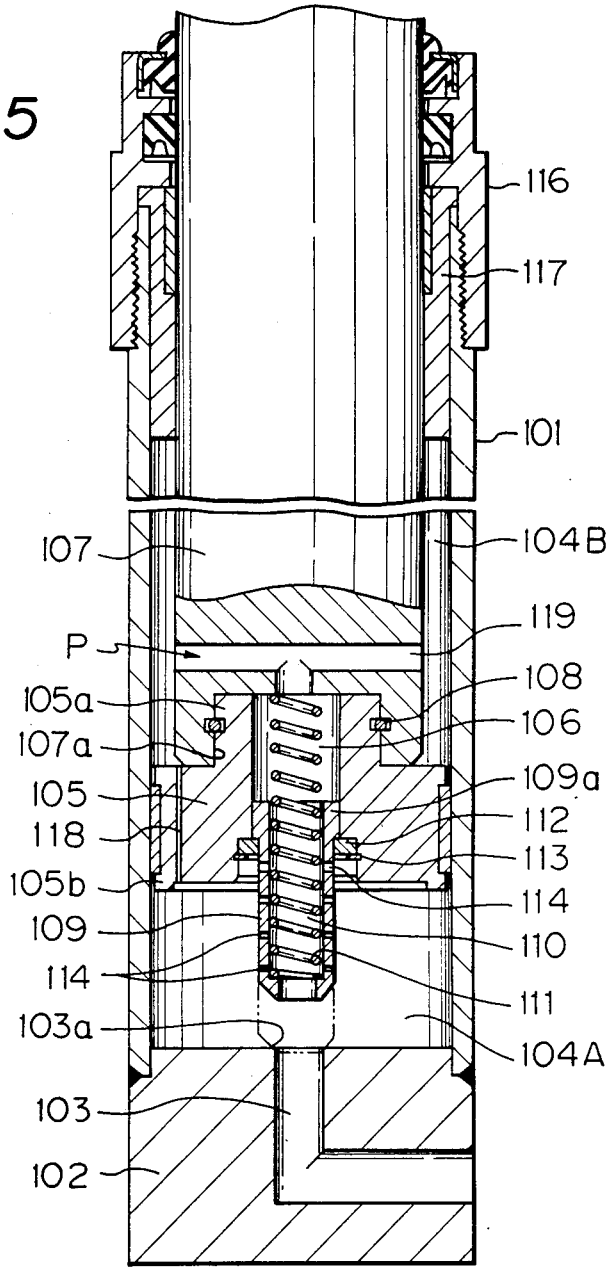
FIG. 5 is a cross sectional view of the cylinder of FIG. 4, illustrating the same state as shown in FIG. 3.
Figure 6:
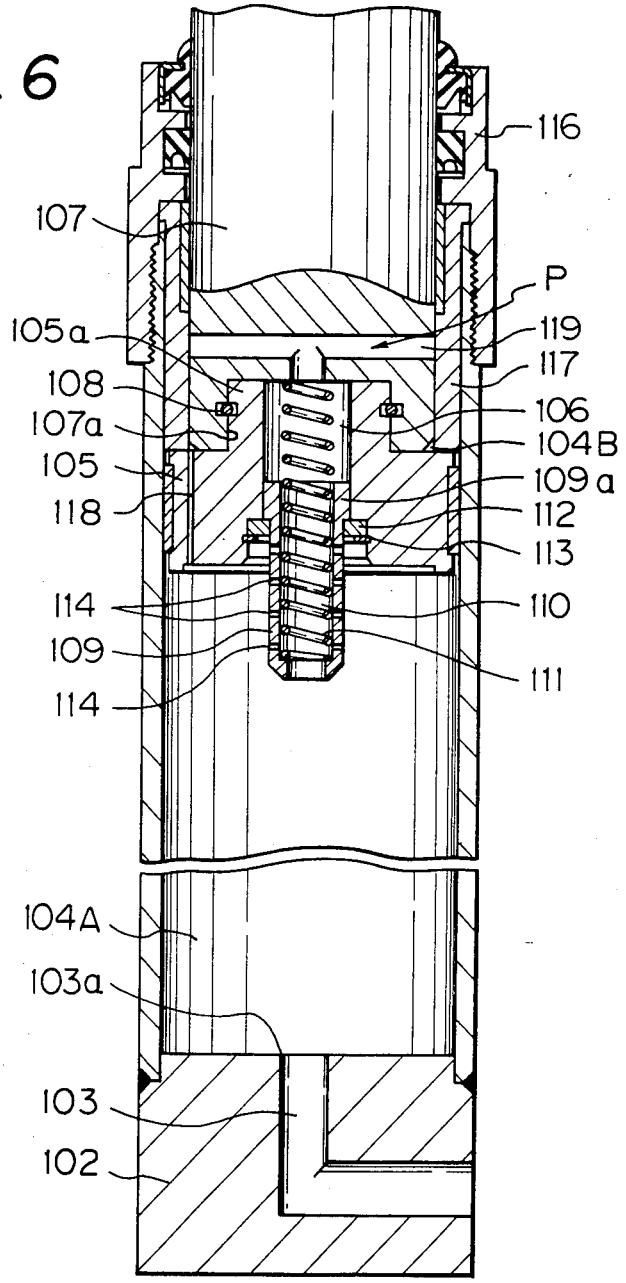
FIG. 6 is a cross sectional view of the cylinder of FIG. 4, illustrating a state wherein the piston is moved to the uppermost position thereof in the cylinder casing.

FIGS. 4 through 6 illustrate a second embodiment of the present invention.

The fluid-operated cylinder of the second embodiment shown in FIGS. 4 through 6 includes many identical or like elements as those of the first embodiment of FIGS. 2 and 3. Therefore, throughout FIGS. 4 through 6, these identical and like elements are designated by the respective reference numerals used in FIGS. 2 and 3 plus one hundred (100). For example, a piston element is designated by reference numeral 105, and a flow rate control valve is designated by reference numeral 109. Therefore, a description of only the difference in the construction of the cylinder of the second embodiment and that of the first embodiment will be first provided hereinbelow. It should be understood that the identical or like elements to those of the first embodiment basically carry out identical operations, respectively.

Referring now to FIGS. 4 through 6, a piston rod 107 is formed, at a lower part thereof, with a lateral hole 119 (in this embodiment, a diametrical through-hole is formed) as a fluid passageway opening toward an upper cylinder chamber 104B. The hole 119 is also communicated with a cylindrical bore 106 of the piston element 105. That is, the bottom and upper cylinder chambers 104A and 104B can be communicated with one another by a fluid passageway, generally designated by the reference character "P", comprising the lateral hole 119, the cylindrical bore 106 of the piston element 105, and an axially extending cylindrical bore 110 of the flow rate control valve 109. At this stage, it should be noted that the piston element 105 of this second embodiment is a differential type operated by a difference in area of the two opposite pressure receipt faces. In a cylinder casing 101 there is provided a rod guide 117 in the form of an annular member having an appropriate axial length at an upper end of the cylinder casing 101. The rod guide 117 is provided not only for smoothly guiding the axial movement of the piston rod 107 but also for stopping the upward movement of the piston element 105 at a predetermined upper position in the cylinder casing 101. The rod guide 117 is fixed by a rod covering 116 and closes the afore-mentioned lateral hole 119 when the piston element 105 approaches the predetermined upper position thereof, as illustrated in FIG. 6. The piston element 105 is provided with a small through-hole 118 axially extending through both pressure receipt faces of the piston element 105. The through-hole 118 is provided for maintaining a fluid communication between the bottom and upper cylinder chambers 104A and 104B and mainly operates to control a flow of the working fluid when the piston element 105 is moved upward to a position near the predetermined upper position at which it is stopped by the rod guide 117, and the lateral hole 119 of the piston rod 107 is closed by the rod guide 117.

A description of the operation of the embodiment of FIGS. 4 through 6 will be now provided hereinbelow.

Referring to FIG. 4 illustrating a state wherein the piston element 105 is at the lowest position thereof, the bottom cylinder chamber 104A is communicated with a fluid supply/discharge port 103 through the lowermost orifices 114 of the control valve 109. When the working fluid, i.e., a pressurized oil, is supplied from the outer fluid circuits to the port 103 in order to cause an upward movement of the piston element 105, the working fluid flows into the bottom cylinder chamber 104A by way of the cylindrical bore 110 and the lowermost orifices 114 of the control valve 109. Also, the working fluid in the upper cylinder chamber 104B flows into the bottom cylinder chamber 104A via the small hole 118. Thus, the piston element 105 starts the upward stroke toward the upper most position defined by the rod guide 117. However, since the control valve 109 is urged downward by a spring 111, it is held at the position in which it is in contact with the valve seat **103*a* of the port 103. As a result, in compliance with the upward movement of the piston element 105, the control valve 109 moves out of the cylindrical bore 106 of the piston element 105, and the orifices 114 arranged in the uppermost positions are successively exposed in the bottom cylinder chamber 104A. Thus, the flow rate of the working fluid flowing into the bottom chamber 104A is gradually increased in response to an increase in the amount of upward movement of the piston element 105. That is, the flow rate of the working fluid is initially small and is then gradually increased. Therefore, the initial speed of the piston element 105 is low but is gradually accelerated to a higher speed. When a stop 112 of the piston element engages with a flange portion 109*a* of the control valve 109, the valve 109 is pulled by the piston element 105 and begins to move up together with the piston element 105, as illustrated in FIG. 5 by a solid line. As a result, the port 103 is directly communicated with the bottom cylinder chamber 104A. Also, the bottom cylinder chamber 104A and the upper cylinder chamber 104B are mutually and completely communicated with one another via the fluid passageway "P" including the lateral hole 119. Therefore, the piston element 105** thereafter moves up at an appropriate high speed.

When the piston element 105 approaches the uppermost position, and the lateral hole 119 is closed by the rod guide 116, the working fluid in the upper cylinder chamber 104B is permitted to leak out of the chamber 104B into the bottom cylinder chamber 104A only via the small hole 118. That is, the flow rate is extremely limited, due to the closure of the lateral hole 119. As a result, the piston speed is decelerated by the resistance caused by the limited flow of the working fluid. Therefore, the piston element 105 reaches the uppermost position determined by the rod guide 117 at a sufficiently reduced speed without the occurrence of shock.

When the downward movement of the piston element 105 is carried out from the uppermost position as shown in FIG. 6, the working fluid is initially discharged from the bottom cylinder chamber 104A toward the outer fluid circuits via the port 103. However, since the lateral hole 119 of the piston rod 107 is closed by the rod guide 116, the working fluid in the bottom cylinder chamber 104A is permitted to flow into the upper cylinder chamber 104B only via the small hole 118. That is the flow rate is extremely limited. Therefore, the starting speed of the piston element 105 is very low. When the piston element 105 moves down to a position whereat the lateral hole 119 is not closed by the rod guide 117, the upper and bottom cylinder chambers 104B and 104A are communicated with one another via the fluid passageway "P". Thus, the piston element 105 can move down at an appropriate high speed.

When the piston element 105 approaches the lowermost position, the flow rate control valve 109 operates so as to gradually decelerate the speed of the piston element 105. That is, before the control valve 109 comes into contact with the valve seat **103*a*, the working fluid in the bottom cylinder chamber 104A is directly discharged via the port 103 and also flows into the upper cylinder chamber 104B via the fluid passageway "P". Therefore, the piston element 105 moves down at a high speed. However, after the control valve 109 comes in contact with the valve seat 103*a*, as shown in FIG. 5 by a phantom line, the flow rate of the working fluid is extremely limited. That is, the working fluid is discharged only via the orifices 114. Further, in compliance with the approach of the piston element 105 to the lowermost position in the cylinder casing 101, the control valve 109 is relatively retracted into the cylindrical bore 106 of the piston element 105, and the orifices 114 arranged at the uppermost positions are gradually withdrawn into the cylindrical bore 106. As a result, the flow rate of the working fluid discharged toward the port 103, via the orifices arranged at the lowermost positions and the cylindrical bore 110 of the control valve 109, is further limited. Accordingly, the speed of the piston element 105 is sufficiently decreased prior to stopping at the lowermost position where the seating portion 105*b* thereof is abutted against the bottom face of the cylinder bottom 102 of the cylinder casing 101**. Consequently, shock is cushioned to the lowest level.

From the foregoing description of the second embodiment, it will be understood that, according to provision of the flow rate control valve 109 and the lateral hole 119 of the piston rod 107, cushioning of shock is carried out at the start and stop of the piston movement at both the uppermost and lowermost positions of the piston element 105. At this stage, it should be noted that if the opening ends of the lateral hole 119 are vertically extended in a longitudinal direction of the piston rod 107, it is possible to delicately control the speed of the piston movement when the piston element 105 approaches or moves away from the uppermost position thereof.

Figure 7:
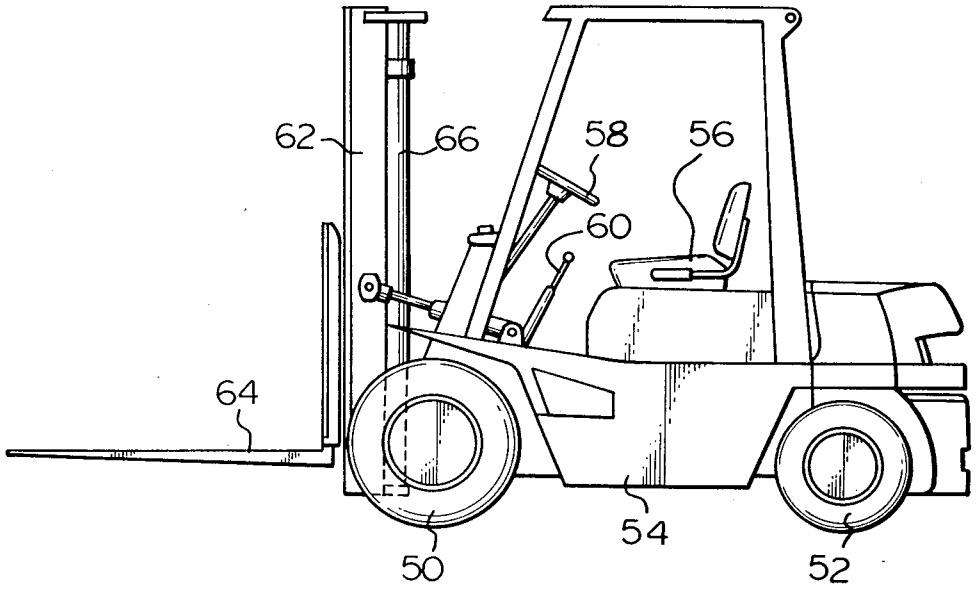
FIG. 7 is a schematic side elevational view of an industrial lift truck accommodating therein a load lifting fluid-operated cylinder with a shock cushioning unit of the present invention.

FIG. 7 illustrates an example of industrial load handling wheeled machine, i.e., a load lifting truck, in which the fluid-operated cylinder of the present invention is assembled.

In FIG. 7, a load handling lift truck has a pair of front wheels 50 and a rear wheel or a pair of rear wheels 52 mounted below a truck body 54. On the truck body 54, there are provided a driver's seat 56, a steering wheel 58, and an operating lever 60. In front of the truck body, a pair of outer masts 62 and a pair of inner masts (not shown in FIG. 7) are arranged so as to construct well known left and right uprights. The uprights carry thereon a load handling device, such as a fork tine 64. A lift cylinder or a pair of lift cylinders 66 constructed in accordance with the present invention are mounted in front of the truck body 54 so as to move the inner masts as well as the load handling device 64 up and down. Since the lift cylinder or cylinders 66 include a shock cushioning unit comprising the afore-described flow rate control valve unit, effective shock cushioning can be achieved during the load handling operation by the driver of the lift truck.

Although the invention has been explained referring to the preferred embodiments of the invention above, modifications and variations may be carried out within the scope of the present invention as set forth in claims.

We claim:

1. A fluid-operated cylinder adapted to be used as a load lifting cylinder, comprising:

a cylinder casing having a cylindrical bore axially extended between first and second ends thereof, said first end having a fluid supply/discharge port formed at an inner end thereof and having a valve seat, and said second end having an open end through which a piston rod is axially movably received in said cylinder bore;

a piston element arranged at an inner end of said piston rod so as to be movable with said piston rod and having first and second pressure-receipt faces defining, in a cylindrical bore of said cylinder casing, a first cylinder chamber adjacent to said fluid supply/discharge port, and said second pressure-receipt face defining, in said cylindrical bore of said cylinder casing, a second cylinder chamber extending around said piston rod;

flow rate control valve means axially movably arranged in said piston element and cooperating with said valve seat for causing a gradual change in a flow rate of a working fluid flowing from said fluid supply/discharge port to said first cylinder chamber, and vice versa, through a predetermined amount of piston stroke when said piston element and said piston rod move away from and toward a bottom position adjacent to said fluid supply/discharge port, thereby cushioning shock generated in said fluid-operated cylinder at a time of starting or stopping movement of said piston element;

said flow rate control valve means including:

a cylindrical hollow valve body arranged in a cylindrical bore of said piston element so as to be axially movable between inwardly retracted and outwardly extended positions from said first pressure-receipt face of said piston element, said cylindrical hollow valve body having an axially extended through-bore forming a central fluid passageway, an inner end portion cooperating with a stop means arranged in said cylindrical bore of said piston element so as to permit a predetermined amount of axial movement of said cylindrical hollow valve body, an outer end portion capable of being tightly seated against said valve seat of said fluid supply/discharge port, and a plurality of radial orifice means arranged at a plurality of axially spaced positions of said cylindrical hollow valve body, respectively, for changing an extent of fluid communication between said axially extended through-bore of said cylindrical hollow valve body and said first cylinder chamber in response to axial movement of said cylindrical hollow valve body, and;

spring means arranged in said cylindrical bore of said piston element and in said axially extended through-bore of said cylindrical hollow valve body for constantly urging said cylindrical hollow valve body from said inwardly retracted position toward said outwardly extended position; and said piston rod is formed with fluid passageway means fluidly communicated with said cylindrical bore of said piston element and having at least one open end disposed in an outer circumference of said piston rod for communicating said cylindrical bore of said piston element as well as said axially extended bore of said cylindrical hollow valve body with said second cylinder chamber of said cylinder casing when said piston element is axially moved to said first end of said cylinder casing, a means is arranged adjacent to said second end of said cylinder casing for closing said open end of said fluid passageway means of said piston rod when said piston element is axially moved to a position adjacent to said second end of said cylinder casing, and said piston element is formed with one small through-hole piercing said first and second pressure-receipt faces for providing a constant fluid communication between said first and second cylinder chambers and for permitting fluid in the second chamber to slowly escape into the first chamber.

2. A fluid-operated cylinder according to claim 1, wherein said cylindrical hollow valve body has an axial length such that when said piston element comes to said bottom position adjacent to said fluid supply/discharge port, said cylindrical hollow valve body is moved back into said inwardly retracted position against said spring means while seating, at said outer end portion thereof, against said valve seat of said fluid supply/discharge port.

3. A fluid-operated cylinder according to claim 2, wherein one of said plurality of radial orifice means is disposed at a position adjacent to said outer end portion of said cylindrical hollow valve body so as to communicate said fluid supply/discharge port with said first cylinder chamber of said cylinder casing when said outer end portion of said cylindrical hollow valve body is seated against said valve seat of said fluid supply/discharge port.

4. A fluid-operated cylinder according to claim 3, wherein said piston element is formed, in said first pressure-receipt face, with a counter bore for directly communicating said one of said plurality of orifice means of said cylindrical hollow valve body with said first cylinder chamber of said cylinder casing, said counter bore being coaxial with said cylindrical bore of said piston element.

5. A fluid-operated cylinder according to claim 4, wherein said stop cooperating with said inner end portion of said cylindrical hollow valve body is a ring-form member fixed in said counter bore of said piston element and having a central bore in which said cylindrical hollow valve body is slidably fitted.

6. A fluid-operated cylinder according to claim 1, wherein said plurality of radial orifice means are formed in such a manner that diameters of said orifice means are made successively larger from said orifice means arranged near said outer end portion toward said orifice means arranged near said inner end portion of said cylindrical hollow valve body.

7. A fluid-operated cylinder according to claim 1, wherein said means arranged adjacent to said second end of said cylinder casing for closing said open end of fluid passageway means of said piston rod comprise an annular guide member fixed to said cylinder casing and having an axially extended cylindrical inner wall in which said piston rod is slidably fitted.

8. A fluid-operated cylinder according to claim 1 wherein said fluid passageway means of said piston rod is a diametrically extended through-bore formed in said piston rod, said diametrically extended through-bore has a centrally arranged opening communicated with said cylindrical bore of said piston element.

9. A lift truck comprising:

a truck body having a pair of front wheels and a driver's seat disposed behind and above said front wheels;

a pair of left and right uprights including a pair of left and right outer masts provided at front portions of said truck body of said lift truck, and a pair of left and right inner masts arranged to be moved up and down between and along said outer masts;

a load handling attachment carried by a lift member supported on said pair of left and right inner masts; and at least one lift cylinder disposed at a front portion of said truck body for lifting and lowering said inner masts and said load handling attachment, said lift cylinder comprising:

a cylinder casing having a cylindrical bore axially extended between first and second ends thereof, said first end having a fluid supply/discharge port formed at an inner end thereof with a valve seat, and said second end having an open end through which a piston rod is axially movably received in said cylinder bore;

a piston element arranged at an inner end of said piston rod so as to be movable with said piston rod and having first and second pressure-receipt faces, said first pressure-receipt face defining, in a cylindrical bore of said cylinder casing, a first cylinder chamber adjacent to said fluid supply/discharge port, and said second pressure-receipt face defining, in said cylindrical bore of said cylinder casing, a second cylinder chamber extending around said piston rod;

connecting means for connecting a top of said piston rod and said inner masts;

flow rate control valve means axially movably arranged in said piston element and cooperating with said valve seat for causing a gradual change in a flow rate of a working fluid flowing from said fluid supply/discharge port to said first cylinder chamber, and vice versa, through a predetermined amount of piston stroke when said piston element and said piston rod move away from and toward a bottom position adjacent to said fluid supply/discharge port, thereby cushioning a shock generated in said lift cylinder at a time of starting or stopping movement of said piston element;

said flow rate control valve means including:

a cylindrical hollow valve body arranged in a cylindrical bore of said piston element so as to be axially movable between inwardly retracted and outwardly extended positions from said first pressure-receipt face of said piston element, said cylindrical hollow valve body having an axially extended through-bore forming a central fluid passageway, an inner end portion cooperating with a stop means arranged in said cylindrical bore of said piston element so as to permit a predetermined amount of axial movement of said cylindrical hollow valve body, an outer end portion capable of being tightly seated against said valve seat of said fluid supply/discharge port, and a plurality of radial orifice means arranged at a plurality of axially spaced positions of said cylindrical hollow valve body, respectively, for changing an extent of fluid communication between said axially extended through-bore of said cylindrical hollow valve body and said first cylinder chamber in response to axial movement of said cylindrical hollow valve body; and spring means arranged in said cylindrical bore of said piston element and in said axially extended through-bore of said cylindrical hollow valve body for constantly urging said cylindrical hollow valve body from said inwardly retracted position toward said outwardly extended position;

said piston rod is formed with fluid passageway means fluidly communicated with said cylindrical bore of said piston element and having at least one open end disposed in an outer circumference of said piston rod for communicating said cylindrical bore of said piston element as wall as said axially extended bore of said cylindrical hollow valve body with said second cylinder chamber of said cylinder casing when said piston element is axially moved to said first end of said cylinder casing, a means is arranged adjacent to said second end of said cylinder casing for closing said open end of said fluid passageway means of said piston rod when said piston element is axially moved to a position adjacent to said second end of said cylinder casing, and said piston element is formed with at least a small through-hole piercing said first and second pressure-receipt faces for providing a constant fluid communication between said first and second cylinder chambers.

* * * * *